US005397108A

United States Patent [19]

Alexander et al.

[11] Patent Number: 5,397,108

[45] Date of Patent: Mar. 14, 1995

[54] PEEPSIGHT FOR BLAST FURNACE TUYERE SENSOR SYSTEM

[76] Inventors: James M. Alexander, 604 Stratford Ter., Valparaiso, Ind. 46383; Russell K. McComb, Jr., 345 Birch St. NW., DeMotte, Ind. 46310

[21] Appl. No.: 282,316

[22] Filed: Jul. 29, 1994

[51] Int. Cl.[6] ..... C21B 7/00

[52] U.S. Cl. ..... 266/100; 266/269

[58] Field of Search ..... 266/100, 269; 350/96.1

[56] References Cited

U.S. PATENT DOCUMENTS 4,619,533 10/1986 Lucas et al. ..... 266/269

5,071,105 12/1991 Donze ..... 266/100

FOREIGN PATENT DOCUMENTS 8901208 5/1989 Netherlands .

*Primary Examiner*—Peter D. Rosenberg

*Attorney, Agent, or Firm*—Armstrong, Westerman, Hattori, McLeland & Naughton

[57] ABSTRACT

A peepsight for a blast furnace tuyere sensor system comprises a housing in which is mounted a colored glass viewing window and one end of a fiber optic cable directed toward a tuyere so that an operator can view the interior of the furnace and the cable can receive light energy emitted at the tuyere for transmittal of such light energy to an optical sensor.

2 Claims, 2 Drawing Sheets

PEEPSIGHT FOR BLAST FURNACE TUYERE SENSOR SYSTEM

BACKGROUND OF THE INVENTION

1. Field of the Invention

This invention relates to a blast furnace tuyere sensor system and more particularly to a novel peepsight enabling an operator to inspect the condition of the tuyeres and receipt of light from the tuyeres by one end of a fiber optic cable mounted in the peepsight and connected at the other end to an optical sensor.

2. Description of Related Art

With the advent of pulverized coal injection into blast furnaces, it becomes critical to be able to detect problem in the injection system at the tuyeres. As coal injection rates increase, furnace downtime resulting from tuyere, blowpipe, and upper assembly failure also increases, often resulting in catastrophic furnace breakouts and damage to furnace auxiliary equipment.

It is known to use a photosensitive resistor to measure the absence of light from a tuyere through which finely divided coal is being injected into a blast furnace, thereby indicating blockage of the tuyere and enabling coal flow to that tuyere to be shut off. Netherlands patent document 8,901,208 discloses such a system.

As described in a copending application, entitled "Blast Furnace Tuyere Sensor System," of the present inventors, we have found that the condition of tuyeres near to a plugged or blocked tuyere is indicative of possible failure of those nearby tuyeres. Such condition we call a "bright tuyere." We have found that a bright tuyere can be caused by several abnormal conditions, i.e. (1) a plugged injection lance, (2) sensor failure, or (3) coal in the bustle pipe of the furnace feeding air to the tuyeres. The carrying over of coal into the bustle pipe is an emergency condition which must be attended to immediately to avoid catastrophic consequences. When a tuyere shows blocked, while a downstream tuyere shows bright, the bright tuyere condition is being caused by burning coal being carried over from the blocked tuyere. A bright tuyere condition always needs to be investigated to avoid burnout of the tuyere and costly shutdown of the furnace.

SUMMARY OF THE INVENTION

Therefore, it is among the other objects of the present invention to provide means to detect a bright tuyere condition as well as plugged tuyeres. This is accomplished by providing a special peepsight by means of which such tuyere conditions can be observed by the operator through a colored glass window, and light emitted at the tuyere can be received by a fiber optic cable mounted in the peepsight, an end portion of which cable is in the form of a right angle facing toward the tuyere to receive light energy emitted at the tuyere.

DESCRIPTION OF PREFERRED EMBODIMENTS

Figure 1:
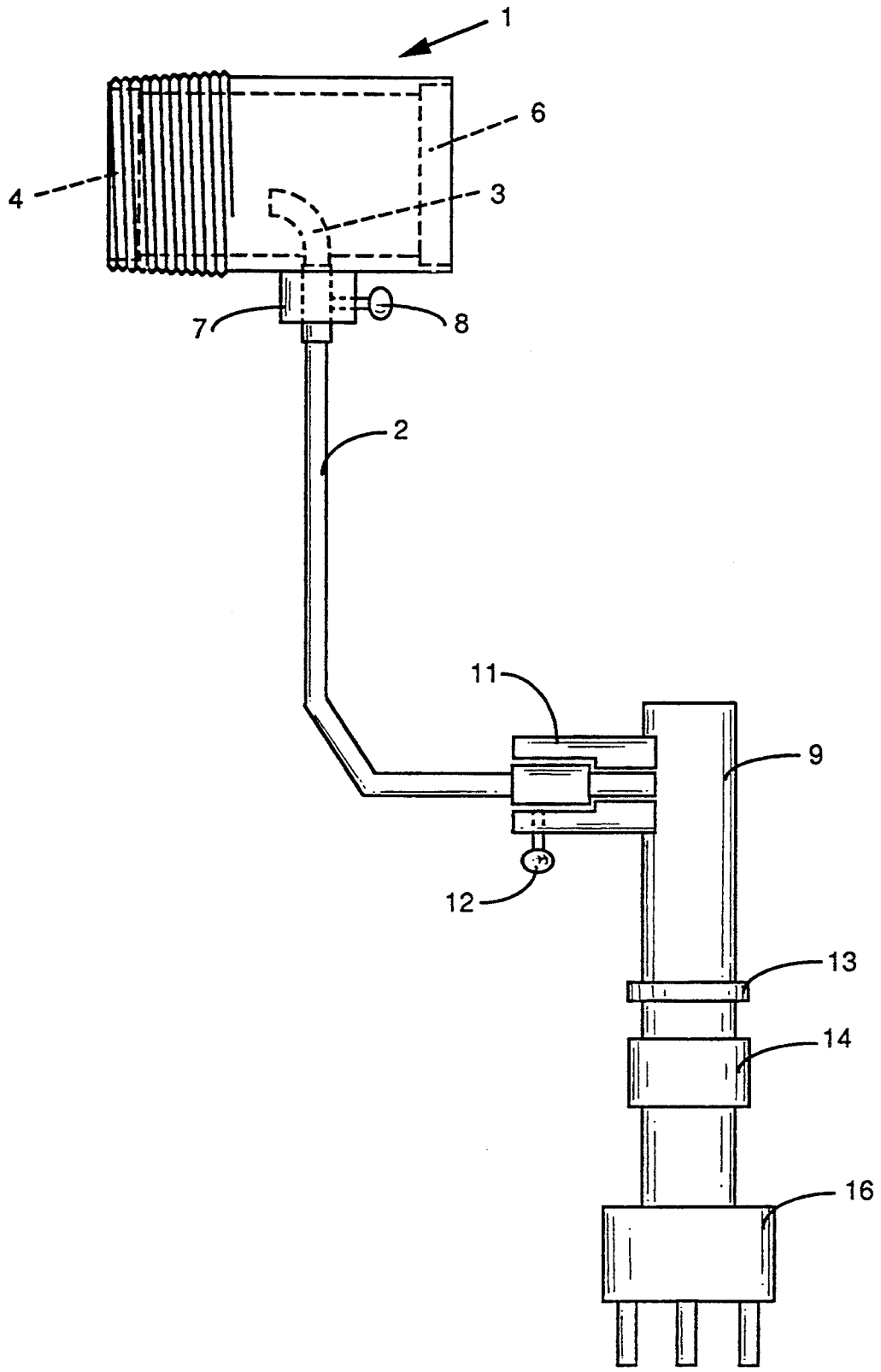
FIG. 1 is a sketch in side elevation of the peepsight and sensor in accordance with the invention.

In FIG. 1, the peepsight is denoted generally by the numeral 1. A multi-mode, multi-fiber, fused silica optical cable 2, encased in stainless steel armor and a protective fire sleeve, has a special 90 degree termination portion 3 facing toward the tuyere and away from an observation port comprising a cobalt blue glass window 4 permitting a furnace operator to view the inside of the furnace by shielding the extremely bright light, while sealing the optic cable aperture from adverse environmental conditions such as dust, fumes, and tramp light, all of which adversely affect system sensitivity. A clear glass window 6 faces inwardly toward the tuyere and provides for maximum light transmission to the optic cable aperture, while sealing the peepsight from the process. Cable 2 is connected to the peepsight by means of bushing 7 and set screw 8 and to a photosensitive sensor housing 9 by means of bushing 11 and set screw 12. This arrangement allows the use of the optic cable while maintaining the integrity of the peep sight seal. Sensor housing 9 is connected to a tube end female adaptor 13, which, in turn, is connected to a hardware mounting 14, attached to a standard size, 3-pin RTD plug 16 allowing the sensor to be easily plugged into the system by installing one RTD jack panel near each tuyere site.

Figure 2:
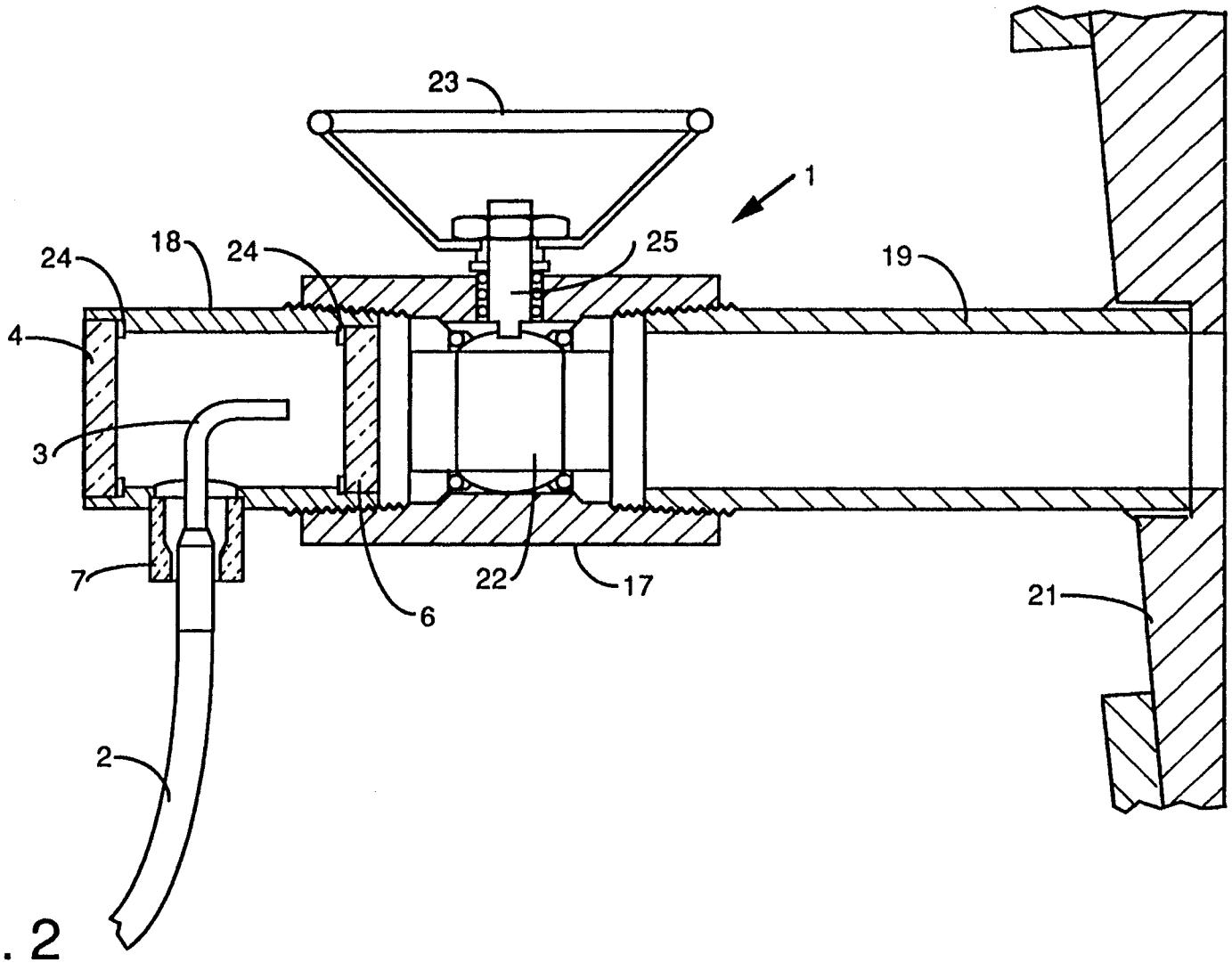
FIG. 2 is a cross-sectional side elevation of the details of the peepsight.

More details of the peepsight are shown in FIG. 2. A tube 17 is internally threaded at each end; one end is threadedly connected to a window housing 18 and the other end is threadedly connected to a tubular connector 19 which is joined to a blowpipe 21. A ball valve 22 which is operated by a handle 23 connected to stem 25 and serves to isolate the peepsight from the furnace. Valve 22 allows the peepsight to be serviced, cleaned or replaced with the furnace at full operating pressure. The furnace side of the valve is at about 2100° F. and 60 psi pressure. Windows 4 and 6 are cemented to housing 18 with a suitable adhesive, as at 24.

The peepsight is designed to allow a furnace operator to use the same port occupied by the fiber optic light guide, and it provides a sealed environment for the light guide end. This prevents dirt, dust and moisture from occluding the light guide end. Due to the small field of view and the critical light angles necessary for efficient transmission of light through a glass fiber, even small amounts of environmental contaminants would quickly degrade the system and result in a need for frequent cleaning. The above described peepsight construction prevents such occurrences.

What is claimed is:

1. A combination peepsight and light detector for a blast furnace tuyere sensor system, comprising an elongated hollow body adapted for connection at one end thereof to a furnace blowpipe in visual communication with a tuyere mounted in a wall of the furnace, a colored viewing window mounted within the hollow body at the other end thereof, a clear window mounted within the body and spaced from the colored window, whereby a furnace operator can view the tuyere through the windows, a fiber optic cable having a right angle end portion disposed in a space between the windows and facing toward the one end of the body and the furnace tuyere, whereby the cable is sealed from the furnace environment and light received by the cable from the tuyere can be transmitted to a light sensor, a ball valve disposed in the interior of the body between the clear window and the one end of the body, and means to actuate the valve from an open position to a closed position in which the windows and the cable are isolated from the furnace.

2. In a blast furnace tuyere sensor system, a combination visual peepsight and bright tuyere detector comprising a tube internally threaded at both ends, a tubular connector externally threaded at one end and threadedly connected to one end of the tube, the other end of the tubular connector being adapted for insertion into an aperture in one end of a blowpipe for visual communication with the interior of the blowpipe and a tuyere disposed at the other end of the blowpipe, a window housing having an inner threaded end threadedly connected to the other end of the tube, a clear glass window mounted in the housing at an inner end thereof, a cobalt blue window mounted at an outer end of the window housing, a ball valve disposed in the tube, means to operate the valve from an open position in which the interior of the furnace is visible through the windows to a closed position in which the peepsight is isolated from the furnace interior, a bushing connected to the window housing at a right angle to a longitudinal axis of the housing, a fiber optic cable mounted in the bushing and thereby connected to the interior of the window housing and having a right angle end portion thereof disposed between the clear glass window and the cobalt blue window, the cable having the right angle end portion facing toward the furnace, whereby an operator can view the furnace interior through the windows and the right angle end portion of the cable can receive light from the tuyere for transmittal to an optical sensor for the detection of a bright tuyere.

* * * * *